US005193667A

United States Patent [19]

Choi

[11] Patent Number: 5,193,667

[45] Date of Patent: Mar. 16, 1993

[54] DOUBLE BUTTON SWITCH OF A VCR

[75] Inventor: Hean Choi, Seoul, Rep. of Korea

[73] Assignee: Goldstar Co., Ltd., Seoul, Rep. of Korea

[21] Appl. No.: 796,188

[22] Filed: Nov. 22, 1991

[30] Foreign Application Priority Data

Nov. 28, 1990 [KR] Rep. of Korea ..... 90-18399

[51] Int. Cl.[5] ..... H01H 3/20

[52] U.S. Cl. ..... 200/331; 200/5 E; 200/50 A; 200/50 C; 200/332; 200/332.1; 200/337; 200/338; 200/341

[58] Field of Search ..... 200/5 D, 5 R, 5 A, 5 B, 200/50 A, 50 C, 330, 331, 332, 332.1, 333, 337, 338, 341; 364/708, 709.01-709.16

[56] References Cited

U.S. PATENT DOCUMENTS

| | | | |
|---|---|---|---|
| 3,941,953 | 3/1976 | Misson et al. | 200/5 R |
| 4,092,527 | 5/1978 | Luecke | 200/5 A X |
| 4,202,038 | 5/1980 | Peterson | 200/5 R X |
| 4,380,693 | 4/1983 | Kuhlmann et al. | 200/330 |
| 4,383,144 | 5/1983 | Kleeb | 200/5 R |
| 4,434,340 | 2/1984 | Kondo | 200/332 |
| 4,517,660 | 5/1985 | Fushimoto et al. | 200/5 A X |
| 4,555,958 | 12/1985 | Stoddard | 200/341 X |
| 4,939,514 | 7/1990 | Miyazaki | 200/5 A X |

*Primary Examiner*—Allan N. Shoap
*Assistant Examiner*—Stephen Cronin
*Attorney, Agent, or Firm*—Morgan & Finnegan

[57] ABSTRACT

Disclosed is a double button device on a VCR comprising a front panel where a double button being set, a cover door being hinged at an inner front panel and opened selectively whenever necessary, an outer button set outward on a cover door, a tact switch for sending an electrical signal to a printed circuit board by an inner or an outer button being pressed, an inner button set on an inner front panel to connect a tact switch with an outer button of frequent use, and a mode switch for changing the mode of a tact switch when a cover door is opened or closed.

3 Claims, 2 Drawing Sheets

DOUBLE BUTTON SWITCH OF A VCR

FIELD OF THE INVENTION

This invention relates to a button switch to make electrical connection in a circuit of a VCR.

BACKGROUND OF THE INVENTION

Generally a conventional button switch device of a VCR comprises a plurality of outer buttons 3 exposedly mounted on the front panel 1 for adjusting volume, selecting channels, etc., and a plurality of inner buttons 4 mounted inside the cover door 2 for adjusting contrast, color, tint, etc., so that the inner buttons 4 for adjusting contrast, color, tint, etc. are prevented for being unnecessarily operated. Namely, the outer buttons 3 are frequently used and therefore exposedly mounted on the front panel 1, while the inner buttons 4 are not frequently used and therefore mounted inside the cover door 2.

However, the functions of a VCR are diversifying greatly, and it is unavoidable that more buttons needs to be installed. Accordingly the tact switches 6 of the printed circuit board installed behind the front panel 1 must be increased to the same number as the number of the buttons, so that it is very difficult to secure a space for receiving them. This hinders miniaturization of the product, impairs productivity, and increases production cost.

SUMMARY OF THE INVENTION

The object of this invention is to provide a double button switch device for a VCR, wherein a single tact switch is able to effect one of two selective functions by a mode switch.

According to the present invention, there is provided a double button switch device of a VCR comprising a front panel, a cover door hinged to said front panel so as to be selectively opened, an outer button arranged outward on said cover door, a tact switch for sending a mode signal selected by said outer button or an inner button to a printed circuit, an inner button arranged on said front panel inside said cover door to connect said outer button with said tact switch, and a mode switch for changing the functional mode of said tact switch selectively by opening and closing said cover door.

The present invention will now be described more specifically with reference to the drawings attached only by way of example.

DETAILED DESCRIPTION OF THE INVENTION

Figure 1:
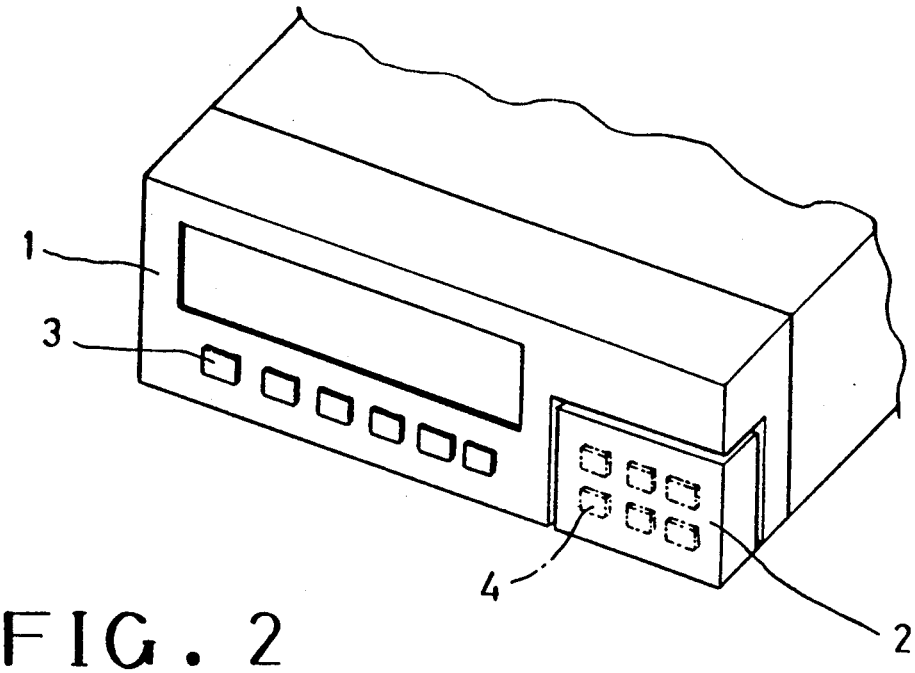
FIG. 1 PRIOR ART
FIG. 1 is a view of a conventional front panel comprising a plurality of button switches.
Figure 2:
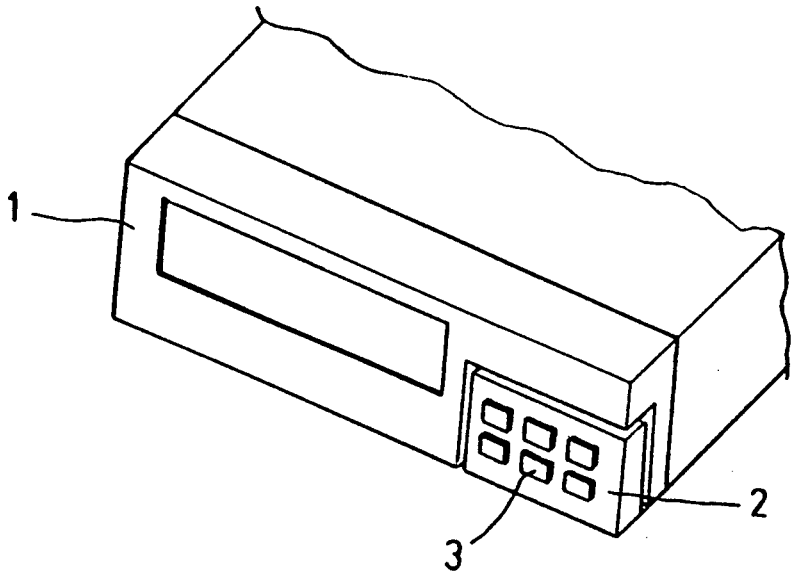
FIG. 2 is a view of a front panel comprising plurality of the inventive button switches.
Figure 3A:
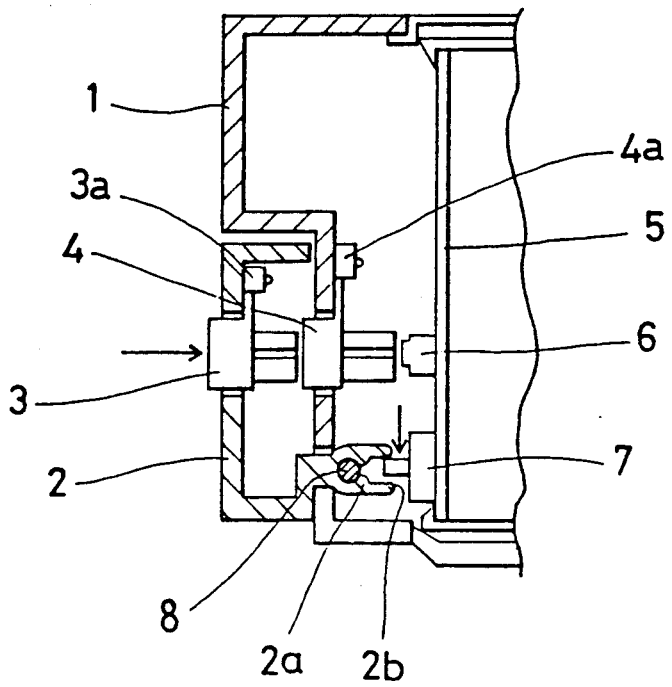
FIG. 3 is a side sectional view of the inventive button switch panel, wherein 3*a* is a side sectional view when a cover door is closed, and 3*b* a side sectional view when a cover door is opened.
Figure 3B:
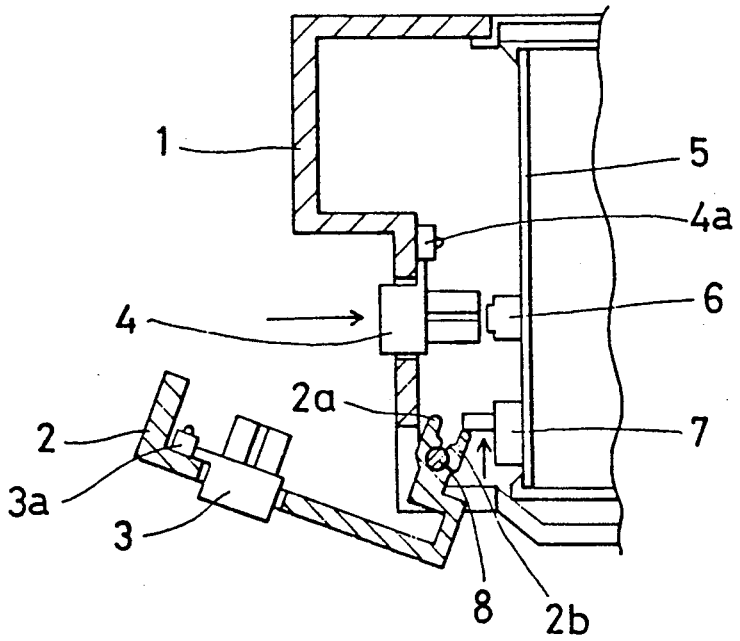

Referring to FIG. 3, a double button switch device of this invention comprises a outer button 3 of frequent use arranged outward on a cover door 2, an inner button 4 of infrequent use arranged on a front panel 1, and a tact switch 6 arranged so as to contact a printed circuit board 5 behind the front panel 1, wherein the outer button, inner button and tact switch are arranged in line with one another.

The cover door 2 has a pair of projections 2*a* and 2*b* formed on a rotating boss of the cover door 2, which is engaged to a hinge pin 8 of the front panel 1, and a mode switch 7 is installed on a part of the printed circuit 5 board so as to be activated when the cover door 2 being rotated.

When operating generally, the outer button 3 of frequent use in the cover door 2, the pushed outer button 3 rotates about a hinge pin 3*a* as shown in FIG. 3A successively to press the inner button 4, which has contacted the tact switch 6 resulting in effecting the outer button 3.

In case of using the inner button 4 of infrequent use, opening the cover door 2 makes the mode switch 7 be pushed up by the projection 2*b* allowing the functional mode of the tack switch 6 to correspond with the function of the inner button 4. If the inner button 4 is pressed pivoted on the hinge pin 4*a*, it contacts the tact switch 6, thus effecting the desired function.

As explained in the above, the inventive button switch device employs a single tact switch 6 in order to selectively perform two functions by adopting a mode switch 7 to be activated when the cover door 2 is opened and closed, so that the number of the tack switches is reduced to a half compared to the conventional device. Hence, it is possible to minimize the space occupied by the buttons in the front panel and the tact switches in the printed circuit board, so that a product of a compact size may be obtained together with improving productivity, thus reducing production cost.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

What is claimed is:

1. A double button switch device of a VCR comprising:

a front panel;

a cover door hinged to said front panel so as to be selectively opened;

an outer button arranged on said cover door;

an inner button arranged on said front panel inside said cover door;

a tact switch for sending a signal selected by one of said outer button and said inner button to a print circuit; and a switching means for changing the functional mode of said tact switch selectively by opening and closing said cover door.

2. A double button switch device of a VCR as claimed in claim 1, wherein said switching means comprises at least one projection formed on said cover door and a mode switch shifted by said at least one projection for changing functional mode.

3. A double button device of a VCR as claimed in claim 1, wherein said outer button arranged on said cover door, said inner button arranged on said front panel and said tact switch are in line with one another.

* * * * *